US010905257B2

(12) United States Patent
Stonehouse

(10) Patent No.: US 10,905,257 B2
(45) Date of Patent: Feb. 2, 2021

(54) STORAGE RACK FOR CANS

(71) Applicant: Ross Stonehouse, Creston (CA)

(72) Inventor: Ross Stonehouse, Creston (CA)

( * ) Notice: Subject to any disclaimer, the term of this patent is extended or adjusted under 35 U.S.C. 154(b) by 0 days.

(21) Appl. No.: 16/519,782

(22) Filed: Jul. 23, 2019

(65) Prior Publication Data

US 2020/0033050 A1 Jan. 30, 2020

Related U.S. Application Data

(60) Provisional application No. 62/702,390, filed on Jul. 24, 2018.

(51) Int. Cl.

| | |
|---|---|
| ***F25D 25/02*** | (2006.01) |
| ***A47F 1/12*** | (2006.01) |
| ***A47F 7/28*** | (2006.01) |

(52) U.S. Cl.

CPC ..... *A47F 1/121* (2013.01); *A47F 7/28* (2013.01); *F25D 25/02* (2013.01); *F25D 2325/023* (2013.01); *F25D 2331/805* (2013.01)

(58) Field of Classification Search

CPC ..... F25D 25/02; A47F 1/082; A47F 1/121; A47F 7/28

See application file for complete search history.

(56) References Cited

U.S. PATENT DOCUMENTS 2,122,322 A * 6/1938 Kidwell ..... A47F 1/087 211/59.2
2,125,000 A * 7/1938 Considine ..... A47J 47/16 211/59.2
2,149,821 A * 3/1939 Sutherland ..... F25D 25/021 312/45
2,239,369 A * 4/1941 Nauert ..... F25D 25/021 211/14
D161,477 S * 1/1951 Lieber et al. ..... D6/675.2
2,954,128 A * 9/1960 Gordon ..... A47F 1/121 211/59.3
2,954,129 A * 9/1960 Gordon ..... A47F 1/121 211/59.3

(Continued)

FOREIGN PATENT DOCUMENTS

DE 29705687 U1 * 6/1997 ..... A47F 1/082
FR 2529451 A1 * 1/1984 ..... A47F 1/121

(Continued)

*Primary Examiner* — Stanton L Krycinski
(74) *Attorney, Agent, or Firm* — Adrian D. Battison; Ade & Company Inc.; Kyle R. Satterthwaite

(57) ABSTRACT

A rack for storing drink cans beneath a wire shelf or other horizontal surface of a storage space such as a refrigerator comprises bottom support wires for the sides of the cans and side support wires for the ends of the cans. The side support and bottom support wires are connected by two longitudinally spaced hanger wires each forming a loop with an upright portion extending connected to the side wires and a horizontal portion connected to the bottom wires. Each loop has a horizontal top wire portion arranged in an overlapping condition for attachment to the shelf or the upper support surface. The forward ends of the side support wires are connected by a first cross wire which is welded to a second cross wire interconnecting the forward ends of the bottom support wires.

14 Claims, 7 Drawing Sheets

(56) References Cited

U.S. PATENT DOCUMENTS 3,007,580 A * 11/1961 Dickson, Jr. ..... A47F 1/121 211/59.3
3,203,553 A * 8/1965 Pendergrast, Jr. ..... A47F 1/121 211/59.2
3,286,846 A * 11/1966 Brandes ..... A47F 1/082 211/59.2
3,780,873 A * 12/1973 Silva ..... A47F 1/121 211/59.3
3,805,964 A * 4/1974 Titus, Jr. ..... F25D 25/02 211/59.2
D255,242 S * 6/1980 Berman ..... D15/89
4,426,008 A * 1/1984 Olson ..... A47F 1/082 211/194
4,732,282 A * 3/1988 Lockwood ..... A47F 7/28 211/59.2
4,776,470 A * 10/1988 Chap ..... A47B 73/002 211/181.1
5,197,611 A * 3/1993 Walton ..... A47K 10/22 211/106
D347,922 S * 6/1994 Trevaskis ..... D6/515
D354,181 S * 1/1995 Smith ..... D6/515
5,687,854 A * 11/1997 Anderson ..... A47K 10/22 211/59.2
6,340,091 B1 * 1/2002 Romeo ..... A47F 1/082 211/113
D544,250 S * 6/2007 Daugherty ..... D6/678.3
D544,251 S * 6/2007 Daugherty ..... D6/678.3
7,617,941 B2 * 11/2009 Colin ..... A47F 5/13 206/503
D859,877 S * 9/2019 Tuang ..... D6/515

FOREIGN PATENT DOCUMENTS

FR 2791539 A1 * 10/2000 ..... A47F 1/121
WO WO-02080738 A1 * 10/2002 ..... A47F 3/063

* cited by examiner

STORAGE RACK FOR CANS

This application claims the benefit under 35 USC 119 (e) of Provisional application 62/702390 filed Jul. 24, 2018.

This invention relates to a storage rack for cans which is designed to be suspended underneath a support surface such as a shelf for example in a refrigerator so as to provide additional storage space for the cans and leave the shelf free for other materials.

According to an aspect of the invention there is provided an apparatus for storing objects beneath a shelf or a horizontal upper surface of a storage space comprising:

a rack comprising bottom support wires and side support wires;

the rack having longitudinally spaced apart front and rear ends and laterally opposite sides, the bottom support wires defining a support surface between the front and rear ends for carrying the objects;

the side support wires defining side walls located at the opposite sides of the bottom and defining side retaining surfaces upstanding from the upper support surface;

the rack including a plurality of wire hangers each connected to the side support wires and the bottom support wires and including a pair of opposite elongate bendable wires each with an upright portion extending upwardly from a first one of the side walls and a lateral wire portion extending towards an opposite one of the side walls at a height above the support surface;

the lateral wire portions being arranged in an overlapping condition in which the lateral wire portions are disposed side-by-side and substantially parallel to one another so that the bottom support wires and side support wires of the rack can be suspended from the shelf or the upper support surface by the wire hangers when the lateral wire portions in the overlapping condition are connected to the shelf or the upper support surface.

In general the apparatus herein provides a rack for storing drink cans beneath a wire shelf or other horizontal surface of a storage space such as a refrigerator comprises bottom support wires for the sides of the cans and side support wires for the ends of the cans. The side support and bottom support wires are connected by two longitudinally spaced hanger wires each forming a loop with an upright portion extending connected to the side wires and a horizontal portion connected to the bottom wires. Each loop has a horizontal top wire portion arranged in an overlapping condition for attachment to the shelf or the upper support surface. The forward ends of the side support wires are connected by a first cross wire which is welded to a second cross wire interconnecting the forward ends of the bottom support wires.

This provides a novel mounting arrangement for suspending a drinks rack beneath a wire shelf.

Preferably, the apparatus includes a tube receiving the lateral portions of the members arranged in the overlapping condition.

In one arrangement, the apparatus further includes an adhesive strip attached to the tube extending longitudinally thereof for interconnecting the tube and the shelf.

In one arrangement, the apparatus further includes a plurality of brackets arranged at longitudinally spaced positions along the tube and forming a cradle thereunder for interconnecting the tube and the shelf.

In the illustrated arrangement, each hanger forms a hoop-shaped member defining the pair of opposite elongate bendable members and further includes an interconnecting portion extending from one of the side walls, across the bottom and to the other one of the sidewalls so as to span between the upright portions of the opposite elongate bendable members.

In the illustrated arrangement, the upper support surface is inclined upwardly and rearwardly from the front end towards the rear end of the bottom, and the front end of the bottom is hooked forwardly and upwardly to retain the objects on the upper support surface. This provides automatic dispensing by gravity of cylindrical objects which are oriented horizontally so as to be rollable.

The arrangement illustrated herein provides under the shelf can storage for refrigerators, cupboards, and pantries etc. with the purpose to store items of food and beverages under existing shelves leaving the surface of the shelves for other items.

In refrigerators, beer and beverages are stored and cooled under existing shelves leaving the shelf surfaces for other food items so that users get their whole fridge back and items automatically roll to the front when an item is removed.

This results in more items in the same space thus enhancing the existing space and becoming more efficient freeing up shelf space.

The design provides simple easy installation for different locations. In one location under a shelf surface where a solid bottom surface is available, a cover overlaps the suspending wire with a round tube and a double sided foam tape is applied to the tube for simple peel and stick for installation.

For wire shelves, straighten out top wires and install between the wires of the shelf and bend back to 90 degrees at original bend, and slide tube on the overlapping wires and place peel and stick under tube to stick to wire shelf to prevent movement.

For wooden shelves, that is where a material of the shelf may receive embedded fasteners in same, simply fasten a holding device such as a bracket like a butterfly clamp located over the tube receiving the top rails to the underside of the shelf.

Arrangements of the present invention for use in refrigerators typically are arranged to support a single layer of cylindrical objects to optimize space saving in fridge.

Case lots, that is unopened cases of a given product, are easily stored without losing shelf space. May also be mounted on ceiling of fridge; where space allows to not interfere with light or thermostat etc.

The front facing portion of the bottom may be curved to the radius of the items to be stored to prevent escape from the front.

The rear portion of the bottom may be upturned to prevent escape from the rear, for example at 90 degrees to the horizontal.

Alternatively, the bottom may be open at the rear such as if the rack is equal in length from front to rear to the depth of the storage space such that a rear interior surface of the storage space can act to prevent the items from falling off the rack at the rear.

Side rails forming the side walls may be placed one on each side of a main frame formed by hangers at a height of approximately one-half the diameter of the cans being stored from the bottom of the side member of the main frame.

When the items are removed the subsequent layers simply fall between the side rails at the bottom until all items are removed For removal of items from the rack, simply grab an item with hands and lift from the curved front portion of the bottom. Upon removal, the remaining items still supported on the rack will flow forward to the curved portion of the bottom.

The wire-frame design allows can positions to be monitored and readjusted by manually guiding cans located rearwardly of others.

For loading the storage unit, simply place items on bottom rail from the front or side, as is most convenient. Add layers from side until full if storage unit is multi layered.

Although the illustrated arrangement of the storage unit is designed for cans, any cylindrical object can be stored in the unit such as jars, glasses, cups, etc.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
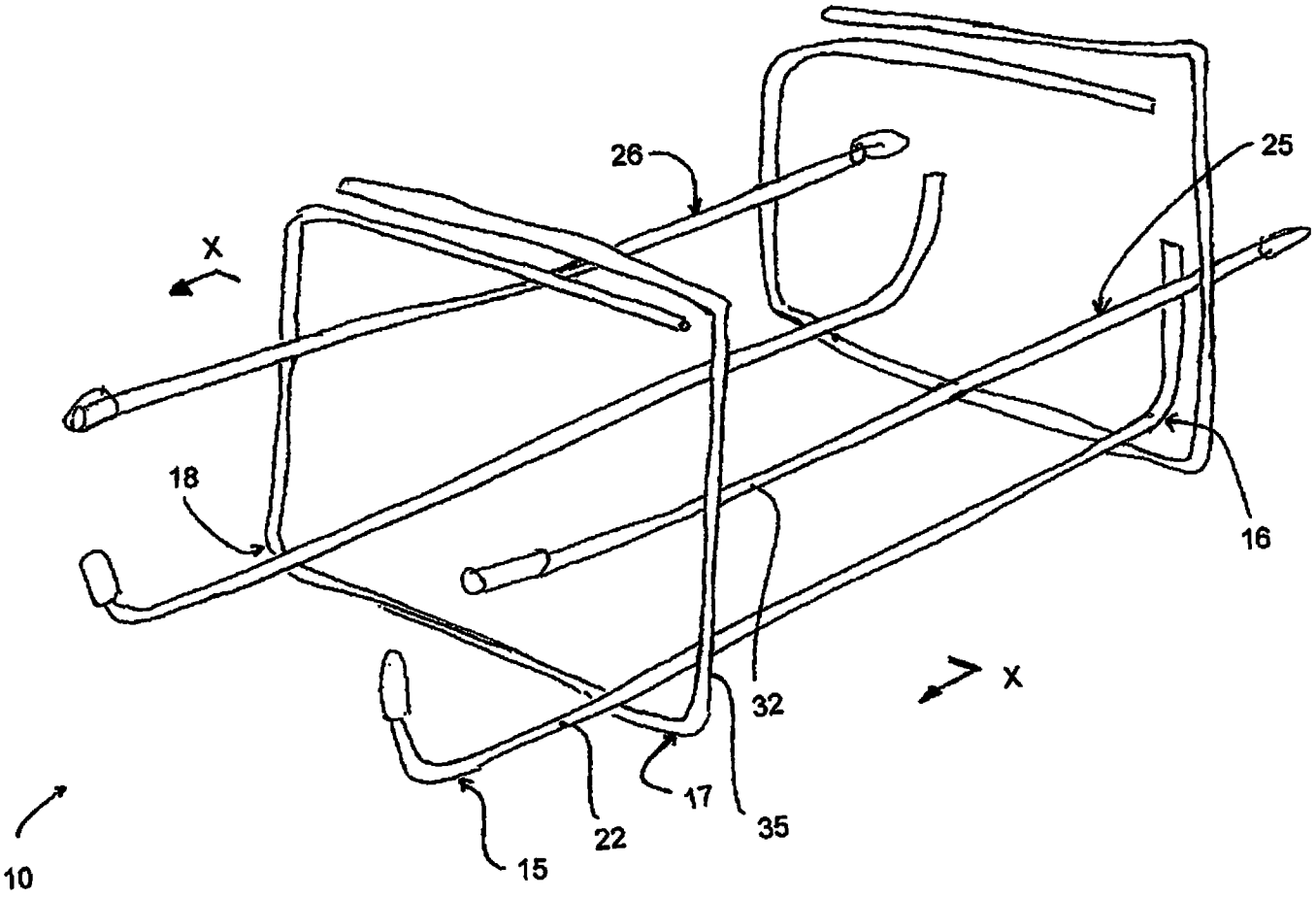
FIG. 1 is a perspective view of apparatus according to an arrangement of the present invention.

FIG. 1 shows a rack 10 for storing objects beneath a shelf or a ceiling of a storage space, for example in a refrigerator or a cupboard, which is designed for mounting in a suspended condition from the same. The illustrated arrangement of the rack that is indicated at 10 is particularly suited for storing circular cylindrical objects, such as cans, which are substantially horizontally oriented so as to be rollable.

The rack 10 comprises a bottom 13 having longitudinally spaced apart front and rear ends 15, 16 and laterally opposite sides 17, 18. As more clearly shown in FIG. 2, the bottom 13 defines an upper support surface 20 between the front and rear ends 15, 16 and the opposite sides 17, 18 that is adapted for carrying the objects. The bottom 13 is formed by a plurality of laterally spaced apart parallel elongate linearly extending rails 22 in the form of wires, which are arranged in a common plane.

The rack 10 also includes side walls 25, 26 located at the opposite sides 17, 18 of the bottom 13 and defining side retaining surfaces 29, 30 upstanding from the upper support surface 20. Each of the side walls 25, 26 is formed by an elongate linearly extending rail 32 located at a spaced height above the bottom 13 and supported at a laterally spaced location from closest one of the bottom rails 22. The side rails 32 are arranged parallel to the bottom rails 22 but in a distinct common plane which is anti-parallel to that in which the bottom rails 22 lie, as will be better appreciated shortly.

The rack 10 further includes a plurality of hangers 35 connected to the side walls 25, 26 at longitudinally spaced positions of the bottom 13, which are used for supporting the side walls and the bottom from a desired mounting location of the rack 10.

In the illustrated arrangement, each hanger 35 forms a hoop-shaped member defining a pair of opposite elongate bendable members 37, 38 and further includes an interconnecting portion 39 of the respective hanger, which extends from one of the side walls 25, 27 across the bottom 13 and to the other one of the sidewalls 25, 26 so as to span between upright portions 40 of the opposite elongate bendable members 37, 38. As such, the hangers 35 also support the rails 22 of the bottom 13 which are mounted to the interconnecting portions 39 thereof.

Referring to FIG. 1, the upper support surface 20 is inclined upwardly and rearwardly from the front end 15 towards the rear end 16 of the bottom 13, and the front end 15 of the bottom is convexly hooked forwardly and upwardly to retain the objects received on the upper support surface 20. In the illustrated arrangement this is achieved by sizing each subsequent hanger from a first one of the hangers closest to the front end 15 slightly smaller in height. Thus, when the substantially horizontally oriented cylindrical objects are received on the upper support surface 20, they will tend to roll by gravity towards the front end 15 of the bottom, and when one of the objects located forwardly of another is removed from the rack 10 then the remaining objects will tend to reposition themselves on the rack by rolling movement induced by gravity. Caps are provided to cover forward ends of the bottom rails to resist damage to the cylindrical objects due to contact with the forward ends.

Figure 2:
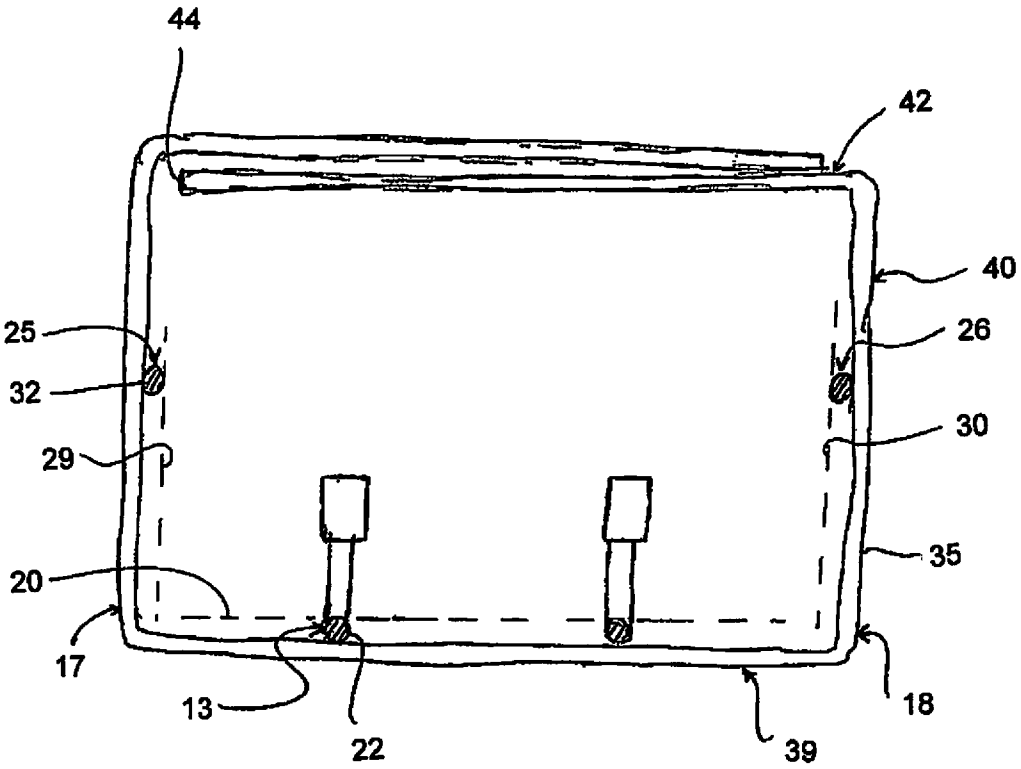
FIG. 2 is a cross-sectional view along line X-X in FIG. 1.

Referring to FIG. 2, each member 37, 38 which is defined by the respective hanger 35 comprises the upright portion 40 extending upwardly from a first one of the side walls 25, 26 and a lateral portion 42 extending towards an opposite one of the side walls 25, 26 at a height above the upper support surface 20. Each member 37, 38 thus acts to substantially bridge across a width of the bottom 13 generally from one side wall 25, 26 to the opposite one. In the illustrated arrangement, the upright portions 40 are arranged vertically upright so as to be perpendicular to the upper support surface 20 and the lateral portions 42 are respectively arranged at right angles to their corresponding upright portions 40 and are substantially parallel to the upper support surface 20. As such, each member 37, 38 of the illustrated arrangement of rack is generally in the shape of an Each lateral portion 42 defines a free end 44 of the respective member 37, 38 which is located closer to the opposite side 17, 18 than that to which that member 37, 38 is connected.

The lateral portions 42 of the members 37, 38 are arranged in an overlapping condition in which the lateral portions 42 are disposed side-by-side and substantially parallel to one another so that the bottom 13 and side walls 25, 26 of the rack 10 can be suspended from the shelf or the ceiling space by the hangers 35 when the lateral portions 42 of the members 37, 38 arranged in the overlapping condition are connected to the shelf or the ceiling of the storage space.

In the illustrated arrangement, substantially the whole of each lateral portion 42 overlaps the other in the length direction of the respective member 37, 38.

Figure 3:
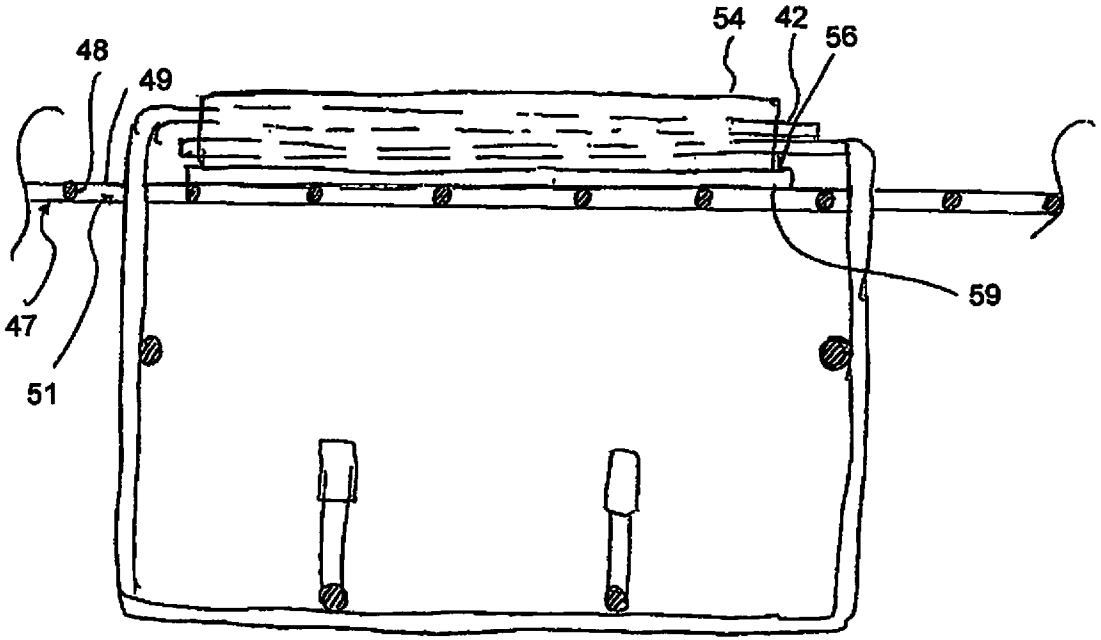
FIG. 3 is a cross-sectional view like FIG. 2 but showing one variant of auxiliary attachment device comprising a tube with adhesive strip attached thereto mounted to a wire-frame shelf.

Depending on the structure of the shelf or the ceiling from which the rack is to be suspended, the lateral portions 42 of the members 37, 38 alone may be sufficient to mount the rack by the hangers 35. For example, as shown in FIG. 3, where the surface receiving the rack 10 is a wire-frame shelf 47 such as that in a refrigerator that comprises a series of parallel wires 48 arranged in a common plane mounted at opposite ends to transversely extending support members 49 which are connected to walls of the storage space (only one support member 49 is shown in FIG. 3), then for attachment to same the lateral portions 42 of the members 37, 38 which are bendable simply may be guided through openings 51 defined between adjacent wires 48 and into the overlapping condition in which both lateral portions 42 are rested across a set of the parallel wires 48 in transverse relation thereto.

Where the lateral portions 42 of the bendable members 37, 38 can act to directly mount the rack 10 to its mounting location, as for example in the above-described scenario, an auxiliary attachment device may be provided to reduce relative movement between the hangers 35 and the attachment location receiving the mounted rack 10. In other cases, the auxiliary attachment device facilitates the connection of the rack to the mounting location.

Figure 4:
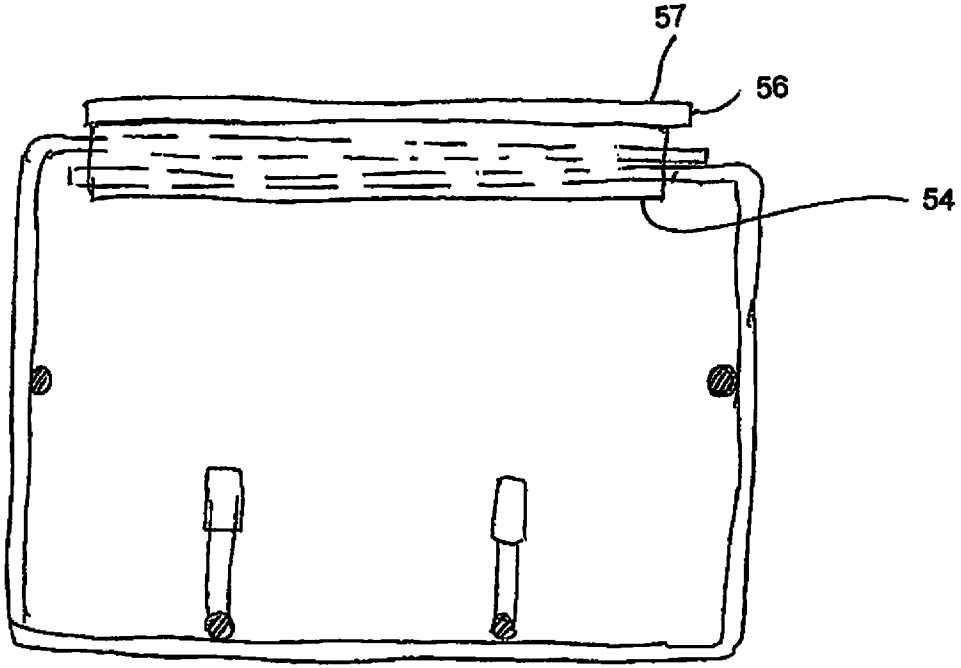
FIG. 4 is a cross-sectional view like FIG. 2 but showing another form of the variant of auxiliary attachment device shown in FIG. 3.
Figure 5:
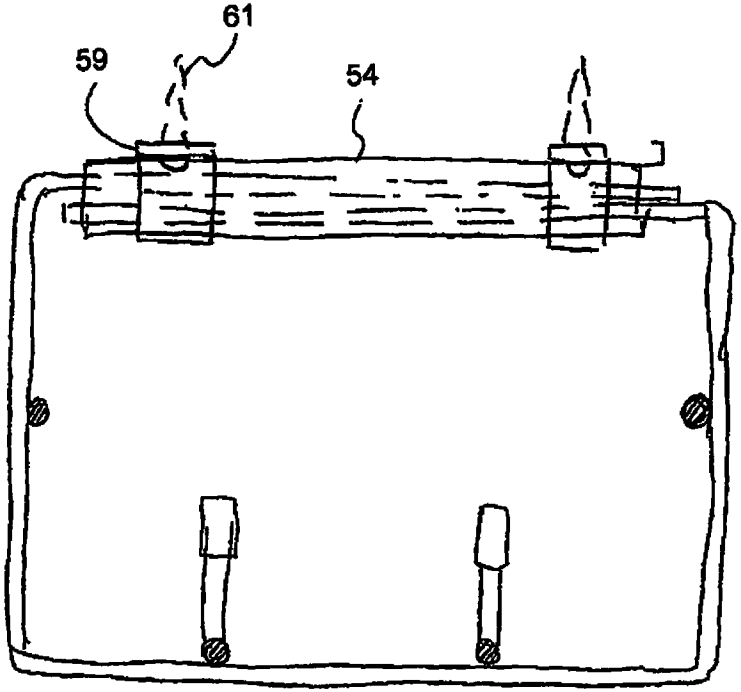
FIG. 5 is a cross-sectional view like FIG. 2 but showing another variant of auxiliary attachment device comprising a tube and brackets.

The auxiliary attachment device comprises a tube 54 receiving the lateral portions 42 of the members 37, 38 arranged in the overlapping condition. The single tube 54 receives a majority of the lengths of the lateral portions 42 of both members 37, 38. Additionally, the auxiliary attachment device includes an adhesive strip 56 for interconnecting the tube 54 and one of the shelf and the ceiling of the storage space which is attached to the tube 54 and provides an adhesive surface 57 opposite to the tube 54 for attaching to the mounting location. The adhesive strip 56 such as a piece of double-sided tap extends longitudinally of the tube 54. The adhesive strip 56 may be arranged on an underside of the tube 54 so as to be located generally intermediate the tube 54 and the upper support surface 20 of the bottom 13 where the lateral portions 42 of the members 37, 38 are located on top of the shelf underneath which the rack 10 is mounted. The adhesive strip 56 may also be disposed on a topside of the tube 54 as shown in FIG. 4 where the lateral portions 42 of the members 37, 38 are located below the shelf or the ceiling.

The auxiliary attachment device may additionally or alternatively include a plurality of brackets 59 arranged at longitudinally spaced positions along the tube 54 and forming cradles thereunder for interconnecting the tube 54 and one of the shelf and the ceiling. The brackets 59 may be in the shape of a "U" so as to extend from one side of the tube 54, thereunder and to the other side of the tube 54 so that ends of the respective bracket 59 are spaced from one another about the circumference of the tube 54. Fasteners 61 such as screws may then be passed through outwardly flaring flanges of the brackets 59 to affix same to the mounting location receiving the rack 10.

Figure 6:
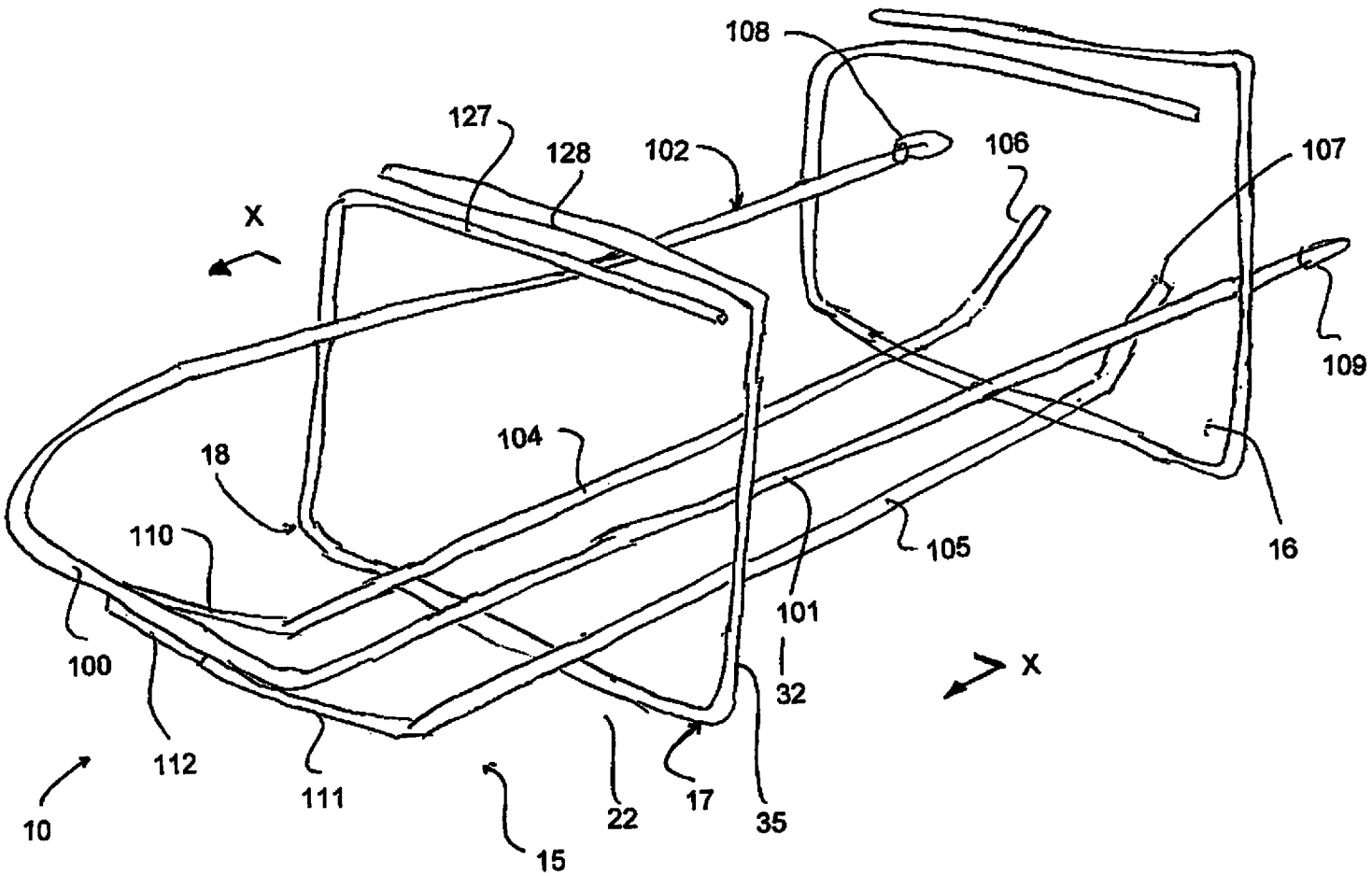
FIG. 6 is an isometric view of an alternative embodiment where the front ends of the side support wires and the front ends of the bottom support wires are connected by first and second cross wires which are then welded together.
Figure 7:
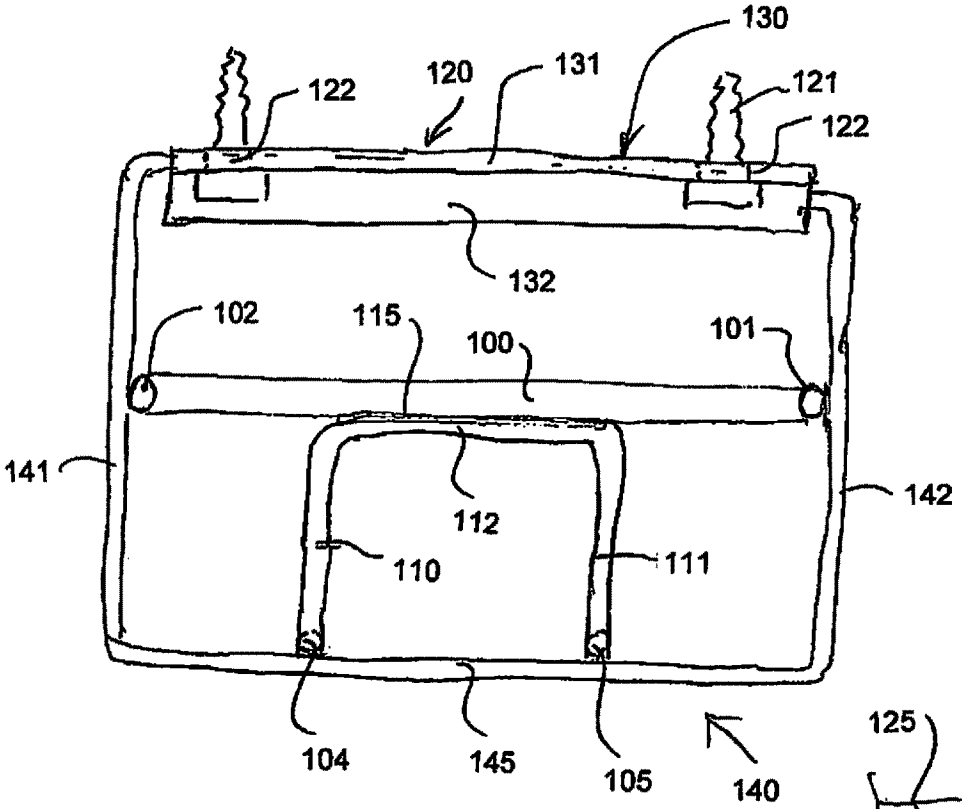
FIG. 7 is a front elevational view of the embodiment of FIG. 6 including a support bracket for attachment to the shelf or upper support surface.

FIGS. 6 and 7 show an alternative embodiment where the front end of the side rails 101 and 102 are connected together to form an integral structure by a cross bar 100 which lies in a common horizontal plane with the side rails. This eliminates a sharp front end of the bottom rails which could create a puncture in a soft can and provides better retention of the can on the bottom rails 104 and 105. The rear ends of the bottom rails are turned upwardly in inclined portions 106, 107 to retain the cans at the rear. The side rails 101, 102 terminate in rear ends 108, 109 in a common plane with the front bar 100. The front end of the bottom rails 104 and 105 are upturned to provide inclined portions 110 and 111 which are connected by a cross bar 112. As best shown in FIG. 7, the rails 104 and 105 are spaced inwardly from the side rails 101, 101 so that the cross bar 112 is shorter than the cross bar 100. In order to stiffen the structure and better hold the cans at the forward end of the bottom rails, the cross bars 100 and 112 are welded together at 115.

FIG. 6 is an isometric view of an alternative embodiment where the front ends of the side support wires and the front ends of the bottom support wires are connected by first and second cross wires which are then welded together.

FIG. 7 is a front elevational view of the embodiment of FIG. 6 including a support bracket 120 for attachment to the shelf or upper support surface.

Figure 8:
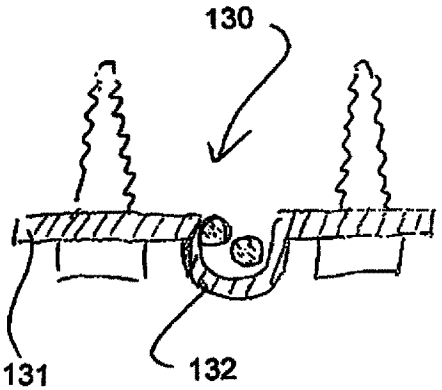
FIG. 8 is a cross-section through the bracket of FIG. 7 showing the top overlapping wires portions attached by screws to an upper support surface at the top of the container or refrigerator.

FIG. 8 is a cross-section through the bracket of FIG. 7 showing the top overlapping wires portions attached by screws 121 to an upper support surface at the top of the container or refrigerator.

Figure 9:
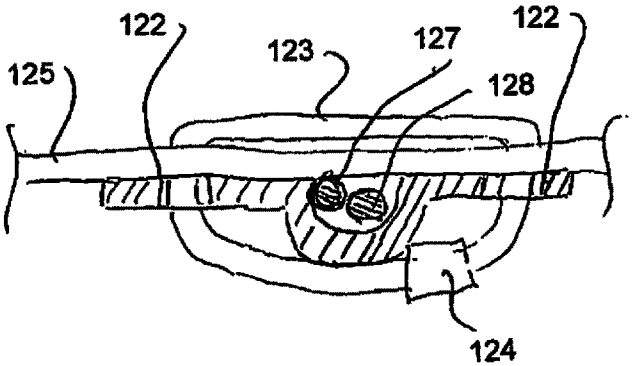
FIG. 9 is a cross-section through the bracket of FIG. 7 showing the top overlapping wires portions attached by loop ties to a wire shelf of the refrigerator.

FIG. 9 is a cross-section through the bracket of FIG. 7 showing the top overlapping wires portions attached by loop ties 123 passed through the holes 122 and fastened by a coupling 124 to the wires 125 of a wire shelf of the refrigerator.

Also shown in FIG. 9 is a pair of zip ties 123 which fasten the top bars 127, 128 of the structure to the shelf to create a quick sturdy installation especially in small fridges with wire shelves using the arrangement described above. The above installation is stronger and dissipates the weight evenly over the wire shelf.

The support bracket 130 forms a cradle 132 receiving the overlapping lateral portions 127, 128 of the wire members of the hanger wires for attachment to either the shelf using the ties or the upper support surface using the screws.

The bracket comprises a flat plate 131 defining two side wings with a channel 132 across to receive both of the overlapping hanger wires 127, 128 therein.

The side support wires 101, 102 are welded to the upstanding side portions 141, 142 of the hanger wire loop 140.

The bottom support wires 104, 105 are welded to horizontal bottom portion 145 of the hanger wire loop 140 at positions spaced inwardly from the sides 141, 142.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. Apparatus for storing objects beneath an upwardly facing support surface of a storage space comprising:

a rack comprising bottom support wires and side support wires;

the rack having longitudinally spaced apart front and rear ends and laterally opposite sides, the bottom support wires defining a support surface between the front and rear ends for carrying the objects;

the side support wires defining side walls located at the opposite sides of the bottom and defining side retaining surfaces upstanding from the upwardly facing support surface;

the rack including a plurality of wire hangers each connected to the side support wires and the bottom support wires and including a pair of opposite elongate bendable wires each with an upright portion extending upwardly from a first one of the side walls and a lateral wire portion extending towards an opposite one of the side walls at a height above the upwardly facing support surface;

the lateral wire portions being arranged in an overlapping condition in which the lateral wire portions are disposed side-by-side and substantially parallel to one another so that the bottom support wires and side support wires of the rack can be suspended from the upwardly facing support surface by the wire hangers when the lateral wire portions in the overlapping condition are connected to the upwardly facing support surface.

2. The apparatus of claim 1 wherein the bottom wires each have portions inclined upwardly and forwardly at a front end to retain the objects received on the upwardly facing support surface.

3. The apparatus of claim 1 wherein each wire hanger forms a hoop-shaped member defining the pair of opposite elongate bendable members and further includes an interconnecting portion extending from one of the side support wires across the bottom and to the other one of the sidewalls.

4. The apparatus of claim 1 further including a tube receiving the overlapping lateral portions of the wire members.

5. The apparatus of claim 4 further including an adhesive strip attached to the tube extending longitudinally thereof with an adhesive surface opposite the tube for interconnecting the tube and the upwardly facing support surface.

6. The apparatus of claim 4 further including at least one support bracket forming a cradle receiving the overlapping lateral portions of the wire members for attachment to the upwardly facing support surface.

7. The apparatus of claim 6 wherein the support bracket comprises a flat plate with a channel across to receive both of the overlapping hanger wires therein.

8. The apparatus of claim 1 wherein the side support wires are welded to the upstanding side portions of the hanger wires.

9. The apparatus of claim 1 wherein the bottom support wires are welded to horizontal bottom portions of the hanger wires.

10. The apparatus of claim 1 wherein the bottom support wires are welded to horizontal bottom portions of the hanger wires at positions spaced inwardly from the sides.

11. The apparatus of claim 1 wherein the side support wires are connected by a cross wire at a forward end.

12. The apparatus of claim 1 wherein the bottom support wires are connected by a cross wire at a forward end.

13. The apparatus of claim 12 wherein the side support wires are connected by a first cross wire at a forward end and the bottom support wires are connected by a second cross wire at a forward end and wherein the first cross wire is attached to the second cross wire.

14. The apparatus of claim 13 wherein the bottom support wires have an upwardly and forwardly inclined front portion so that the second cross wire at the forward end is at the same height as the first cross wire and the first and second cross wires are welded together.

* * * * *